US007335420B2

(12) United States Patent
Noda

(10) Patent No.: US 7,335,420 B2
(45) Date of Patent: Feb. 26, 2008

(54) FEED/TRANSPORT ROLLER

(75) Inventor: Shuhei Noda, Yokohama (JP)

(73) Assignee: Synztec Co., Ltd., Tokyo (JP)

( * ) Notice: Subject to any disclaimer, the term of this patent is extended or adjusted under 35 U.S.C. 154(b) by 394 days.

(21) Appl. No.: 11/018,721

(22) Filed: Dec. 20, 2004

(65) Prior Publication Data

US 2005/0142363 A1 Jun. 30, 2005

(30) Foreign Application Priority Data

Dec. 25, 2003 (JP) ..... 2003-431246
Nov. 30, 2004 (JP) ..... 2004-345308

(51) Int. Cl.
*B32B 27/40* (2006.01)
*G03G 15/14* (2006.01)
*C08G 18/10* (2006.01)
*C08G 18/34* (2006.01)

(52) U.S. Cl. ..... 428/423.1; 399/313; 528/61; 528/66; 528/83

(58) Field of Classification Search ..... 428/423.1; 528/49, 67, 61, 65, 66, 83; 399/313
See application file for complete search history.

(56) References Cited

U.S. PATENT DOCUMENTS 4,111,913 A 9/1978 Schuhmacher et al.
5,585,152 A * 12/1996 Tamura et al. ..... 428/35.1
6,914,117 B2 * 7/2005 Bleys et al. ..... 528/49

FOREIGN PATENT DOCUMENTS

| | | | |
|---|---|---|---|
| EP | 0 386 278 A1 | | 9/1990 |
| EP | 0 748 829 A1 | | 12/1996 |
| EP | 0 894 757 A1 | | 2/1999 |
| FR | 1 534 536 | | 7/1968 |
| JP | 09040739 A | * | 2/1997 |
| JP | 1005637 | | 1/1999 |

OTHER PUBLICATIONS

European Search Report for EP 04030005.5 (foreign equivalent), dated Apr. 26, 2005.

* cited by examiner

*Primary Examiner*—Thao Tran
(74) *Attorney, Agent, or Firm*—Brian A. Gomez; Gomez International Patent Office, LLC

(57) ABSTRACT

The invention provides a feed/transport roller formed of polyurethane material, which roller has high wear resistance as well as low hardness for providing excellent sheet feeding capacity and which meets a recent requirement; i.e., high durability for allowing high-speed operation. The feed/transport roller has an elastic layer formed of a castable polyurethane produced through reaction of a polyester-polyol having a number average molecular weight of 1,000 to 3,000 with a polyisocyanate, wherein the elastic layer is formed from the polyester-polyol, the polyisocyanate, an adipic acid ester derivative serving as a plasticizer, a short-chain diol having a molecular weight of 70 to 120 serving as a chain-extender, and a triol having a number average molecular weight of 3,000 to 5,000 serving as a cross-liking agent.

4 Claims, 5 Drawing Sheets

FEED/TRANSPORT ROLLER

BACKGROUND OF THE INVENTION

1. Field of the Invention

The present invention relates to a feed/transport roller (i.e., a roller for feeding or transporting sheet material) for use in a variety of OA (office automation) machines such as copying machines, facsimiles, and printers.

2. Background Art

Conventionally, feed/transport rollers for use in a variety of OA machines have been required to have excellent sheet transportation capacity and wear resistance. To meet this requirement, such rollers are conventionally formed from EPDM (ethylene-propylene-diene rubber), which has excellent mechanical strength and high friction coefficient.

However, the friction resistance of EPDM is no longer satisfactory in view of recent trends in OA machines; i.e., extension of service life and increase in operation speed.

Meanwhile, studies are also carried out on use of urethane-based material having excellent friction resistance as a material for producing feed/transport rollers.

However, since urethane-based material having low hardness is difficult to produce, the resultant roller tends to exhibit poor feeding performance. Specifically, the hardness of castable urethane material cannot be lowered to a value lower than 50° as measured by means of a durometer (JIS A type). If the hardness is lowered beyond the lower limit, the urethane material will no longer be usable, due to its poor durability.

Feed rollers can also be formed from a millable urethane material. Japanese Patent Application Laid-Open (kokai) No. 11-5637 discloses that a feeding roller is produced from an ϵ-caprolactone-based polyurethane having excellent hydrolysis resistance and mechanical strength. However, when the hardness of the polyurethane is lowered, friction resistance also decreases to a level which is not suitable for practical use.

Feed/transport rollers, particularly feed rollers for use in a sheet-feeding member, are required to have low hardness and high impact resilience for attaining satisfactory sheet feeding capacity, as well as to have durability.

SUMMARY OF THE INVENTION

The present inventors have accomplished the present invention in view of the foregoing. Thus, an object of the invention is to provide a feed/transport roller formed of polyurethane material, which roller has high wear resistance as well as low hardness for providing excellent sheet feeding capacity and which meets a recent requirement; i.e., high durability for allowing high-speed operation.

Accordingly, the present invention provides a feed/transport roller having an elastic layer comprising a castable polyurethane produced through reaction of a polyester-polyol having a number average molecular weight of 1,000 to 3,000 with a polyisocyanate, wherein the elastic layer is formed from the polyester-polyol, the polyisocyanate, an adipic acid ester derivative serving as a plasticizer, a short-chain diol having a molecular weight of 70 to 120 serving as a chain-extender, and a triol having a number average molecular weight of 3,000 to 5,000 serving as a cross-liking agent.

The polyester-polyol may be a diol produced through condensation of at least one species of nonanediol and methyloctanediol with a dibasic acid.

The adipic acid ester derivative may have, an ether moiety in the molecule.

The adipic acid ester derivative may be employed in an amount of 5 to 40 parts by weight with respect to 100 parts by weight of the polyester-polyol.

The triol may have an ether moiety in the molecule.

The elastic layer has a rubber hardness Hs (JIS A type) of 20 to 50°.

The roller exhibits a ratio of maximum value (Max) of an output waveform to minimum value (Min) of the output waveform (Max/Min) falling within a range of 1.00 to 1.20, the output waveform being obtained during measurement of friction coefficient.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with the accompanying drawings, in which.

DETAILED DESCRIPTION OF PREFERRED EMBODIMENTS

Figure 1:
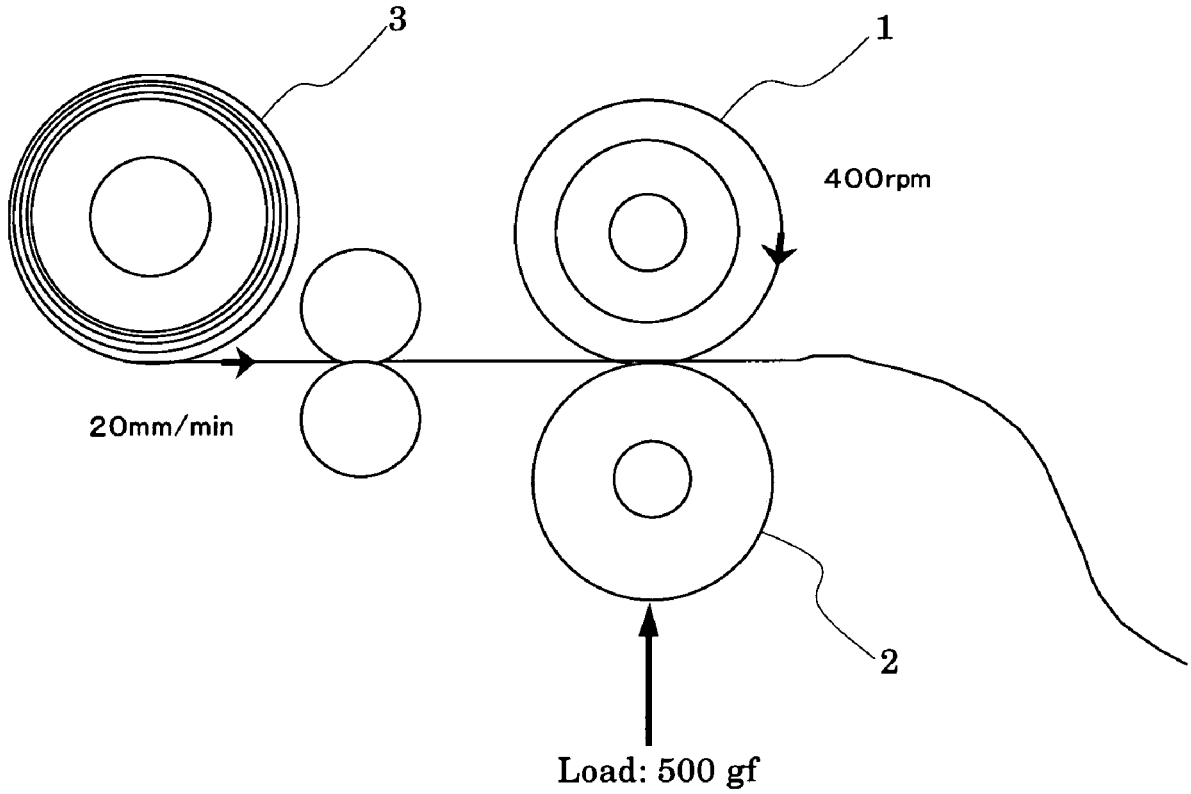
FIG. 1 is a sketch showing a test apparatus employed in Test Example 2.

The feed/transport roller of the present invention has an elastic layer formed from a polyester-polyol having a number average molecular weight of 1,000 to 3,000 and serving as a long-chain polyol for producing a castable urethane material; an adipic acid ester derivative serving as a plasticizer which is not generally employed in such a castable material; a short-chain diol having a molecular weight of 70 to 120 serving as a chain-extender; and a triol having a number average molecular weight of 3,000 to 5,000 serving as a cross-liking agent.

The polyester-polyol has a number average molecular weight falling within the aforementioned range. When the molecular weight is higher than the upper limit, wear resistance is poor, whereas when the molecular weight is lower than the lower limit, a low hardness required for serving as a feed/transport roller cannot be produced.

The polyester-polyol is preferably a diol produced through condensation of at least one species of nonanediol and methyloctanediol with a dibasic acid. In a preferred mode, 1,9-nonanediol is employed as the nonanediol, and 2-methyl-1,8-octanediol is employed as the methyloctanediol. Examples of the dibasic acid include adipic acid, sebacic acid, and azelaic acid. According to the present invention, excellent wear resistance can be maintained through employment of the aforementioned polyester diol.

The polyisocyanate employed in the present invention is preferably, for example, an aromatic polyisocyanate. Examples of the aromatic polyisocyanate include 4,4'-diphenylmethanediisocyanate (MDI) and 3,3-dimethyldiphenyl-4,4'-diisocyanate (TODI). Such isocyanates are employed for enhancing mechanical strength and compressive permanent strain. Among them, use of 4,4'-diphenylmethanediisocyanate (MDI) is particularly preferred.

In the present invention, an adipic acid derivative is employed as a plasticizer. When a customary employed plasticizer such as di-(2-ethylhexyl) phthalate or dioctyl phthalate is added to a castable polyurethane, the polyurethane composition causes bleeding, thereby failing to form a feed/transport roller. However, according to the present invention, a triol having an ether moiety in the molecule serving as a cross-linking agent and an adipic acid ester derivative serving as a plasticizer are used in combination. Therefore, bleeding is securely prevented, and a low-hardness polymer material can be produced.

The adipic acid ester derivative is preferably incorporated into the elastic layer in an amount of 5 to 40 parts by weight based on 100 parts by weight of polyester-polyol. When the amount is less than 5 parts by weight, low hardness is difficult to attain, whereas when the amount is in excess of 40 parts by weight, bleeding tends to occur.

Examples of the adipic acid ester derivative which may be used as a plasticizer in the present invention include adipic acid esters of an alcohol having an ether moiety; e.g., dibutoxyethyl adipate and di(butoxyethoxyethyl) adipate. Examples of commercial products of such adipic acid derivatives include RS 107 (product of Asahi Denka), Monocizer W-260 (product of Dainippon Ink and Chemicals, Inc.), and Plasthal 1203 (Sanyo Trading Co., Ltd.).

According to the present invention, a triol having an ether moiety in the molecule and a number average molecular weight of 3,000 to 5,000 is also employed as a cross-linking agent. Since the polyurethane employed in the present invention for forming the elastic layer is cross-linked with such a high-molecular-weight triol, low hardness (50° or less, JIS A type) can be attained.

Although the present invention employs the aforementioned high-molecular-weight triol serving as a cross-linking agent, a low-molecular-weight triol such as trimethylolethane or trimethylolpropane may be used in combination so long as the effect of the invention is ensured.

Examples of short-chains which may serve as chain-extenders in the present invention include 1,3-propanediol, 1,4-butanediol, and diethylene glycol.

The elastic layer of the present invention is formed by causing the aforementioned materials to react and molding the reaction mixture. No particular limitation is imposed on the production process, and the one-shot method or the pre-polymer method may be employed. In addition, no particular limitation is imposed on the cross-linking conditions, and conventional conditions may be employed.

Since the elastic layer of the present invention is formed of a polyester-polyurethane produced from the aforementioned materials and through molding, a rubber hardness Hs (JIS A type) as low as 20 to 50° can be attained.

The feed/transport roller of the present invention has excellent wear resistance. As described herein later, percent change in outer diameter after an accelerated durability test under high load can be reduced to 1% or less, preferably 0.5% or less.

As mentioned above, the feed/transport roller of the present invention attains both low hardness and low wear amount. In addition, the roller of the invention attains consistent sheet transport performance. That is, the measurement of sheet transportation distance is substantially equal to the theoretical value. Specifically, when a plain paper sheet (30 mm×210 mm, 64 g/cm$^2$) is fed by means of an apparatus employing a roller (outer diameter: 24 mm) having an elastic layer (thickness: 4 mm, width: 24 mm) while the roller 10 is pressed against the sheet at a press load of 100 gf and rotated at 100 rpm, the ratio Fr (Dm/Dt) can be controlled to 0.8 to 1.0, wherein Dm denotes measured value of the sheet transportation distance corresponding to one rotation of the roller, and Dt denotes theoretical value of the sheet transportation distance calculated through the multiplication: the outer diameter of the roller (mm)×π (3.14).

The feed/transport roller of the present invention preferably exhibits a ratio (Max/Min) of maximum value (Max) to minimum value (Min) of the waveform output from friction coefficient measurement, falling within a range of 1.00 to 1.20. When the above ratio (Max/Min) is controlled so as to fall within a range of 1.00 to 1.20, generation of abnormal sound or noise during transportation of sheet can be prevented.

The ratio (Max/Min) is obtained when friction coefficient is measured. Generally, friction coefficient of a sheet medium of paper or another material with respect to a foam material is measured while the sheet medium is in contact with the foam material under application of a load by a load cell or a similar apparatus. The output profile (waveform) is recorded, and the ratio is calculated from the maximum value (Max) and the minimum value (Min). No particular limitation is imposed on the type of output, and current, voltage, weight corresponding to load, etc. may be employed in determining the ratio.

EXAMPLES

The present invention will next be described in detail by way of examples, which should not be construed as limiting the invention thereto.

Example 1

To 100 parts by weight of polyester-polyol (number average molecular weight of 2,000), which had been produced through dehydration-condensation reaction of adipic acid and a diol mixture (1,9-nonanediol (ND) and 2-methyl-1,8-octanediol (MOD) (ND:MOD=7:3)), a plasticizer (RS 107, product of Asahi Denka) (15 parts by weight), MDI, 1,3-propanediol serving as a chain-extender, and Triol P-3403 (product of Daicel Chem. Ind., Ltd., number average molecular weight: 4,000) serving as a cross-linking agent were added. The mixture was stirred at 70° C. for 3 minutes and molded at 120° C., thereby producing elastic layer test pieces. In addition, a feed/transport roller having a core (outer diameter: 24 mm) and an elastic layer (thickness: 4 mm, width 24 mm) formed of the above polymer material and covering the surface of the roller was also produced.

Comparative Example 1

The procedure of Example 1 was repeated, except that PTMG (polytetramethylene ether glycol) having a number average molecular weight of 2,000 was employed as long-chain polyol, to thereby produce a feed/transport roller and test pieces.

Comparative Example 2

The procedure of Example 1 was repeated, except that no plasticizer was employed, to thereby produce a feed/transport roller and test pieces.

Comparative Example 3

The procedure of Example 1 was repeated, except that the triol was altered to PLC 312 (product of Daicel Chem. Ind., Ltd.) having a number average molecular weight of 1,200, to thereby produce a feed/transport roller and test pieces.

Comparative Example 4

A feed/transport roller and test pieces of Comparative Example 4 were produced from EPDM material having a hardness of 35°.

Comparative Example 5

Di-(2-ethylhexyl) phthalate (30 parts by weight) serving as a plasticizer and white carbon (10 parts by weight) serving as reinforcing agent were added to a millable urethane (100 parts by weight), which had been produced through reaction of ϵ-caprolactone and MDI. Subsequently, a peroxide (dicumyl peroxide) and triallyl isocyanurate were added to the above mixture, followed by kneading. The kneaded product was press-molded at 150° C. for 20 minutes, to thereby produce elastic layer test pieces and a feed/transport roller.

Comparative Example 6

The procedure of Example 1 was repeated, except that the plasticizer was altered to di-(2-ethylhexyl) phthalate, to thereby produce a feed/transport roller and test pieces.

Test Example 1

Rubber hardness Hs (JIS K6253) of test pieces of the Examples and the Comparative Examples was determined by means of a type-A durometer. Bleeding on each roller surface was visually observed. The results are shown in Table 1.

Test Example 2

Percent Change in Outer Diameter

Figure 2:
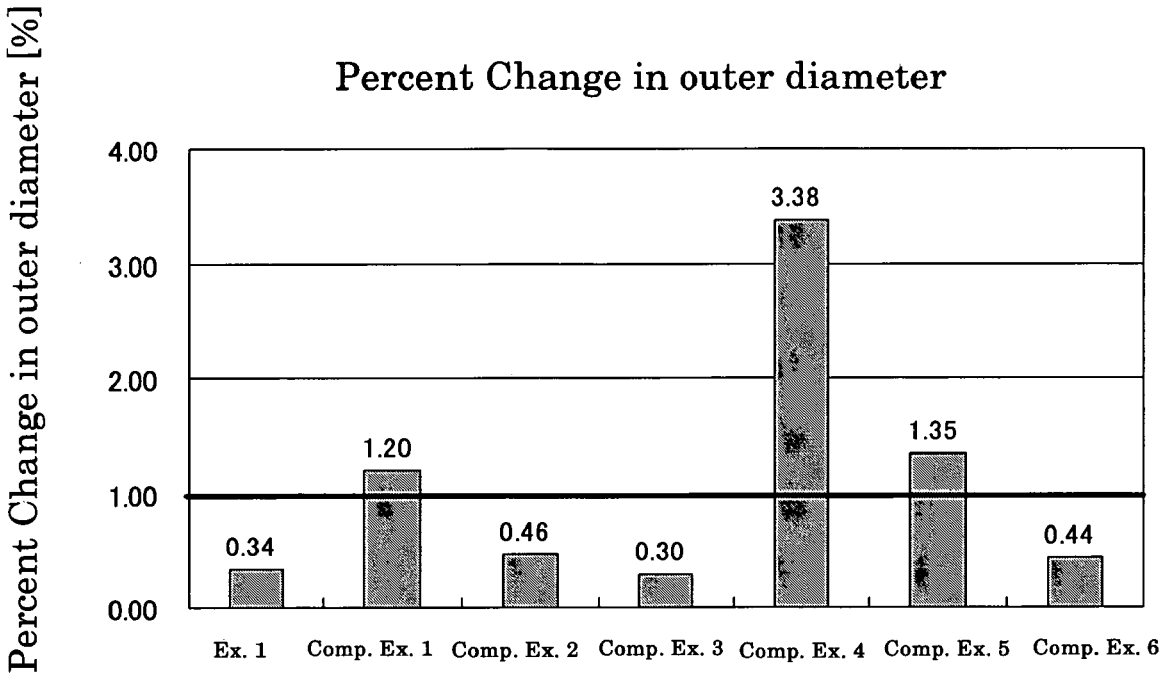
FIG. 2 is a graph showing the results of Test Example 2.

Percent change in outer diameter is obtained by means of a durability test apparatus as shown in FIG. 1. In the durability test apparatus, a feed/transportation roller 1 and a free roller 2 are disposed such that the two rollers oppose each other. A roll sheet 3 (plain paper: 64 g/m$^2$) is fed at 20 mm/min while the free roller 2 is pressed against the sheet at a press load of 500 gf. In the test, the feed/transportation roller was rotated 25,000 times at 400 rpm. Percent change in outer diameter of the roller was determined by measuring the outer diameter before and after the 25,000 rotations. The results are shown in Table 1 and FIG. 2.

Test Example 3

Measurement of Sheet Transportation Distance

Figure 3:
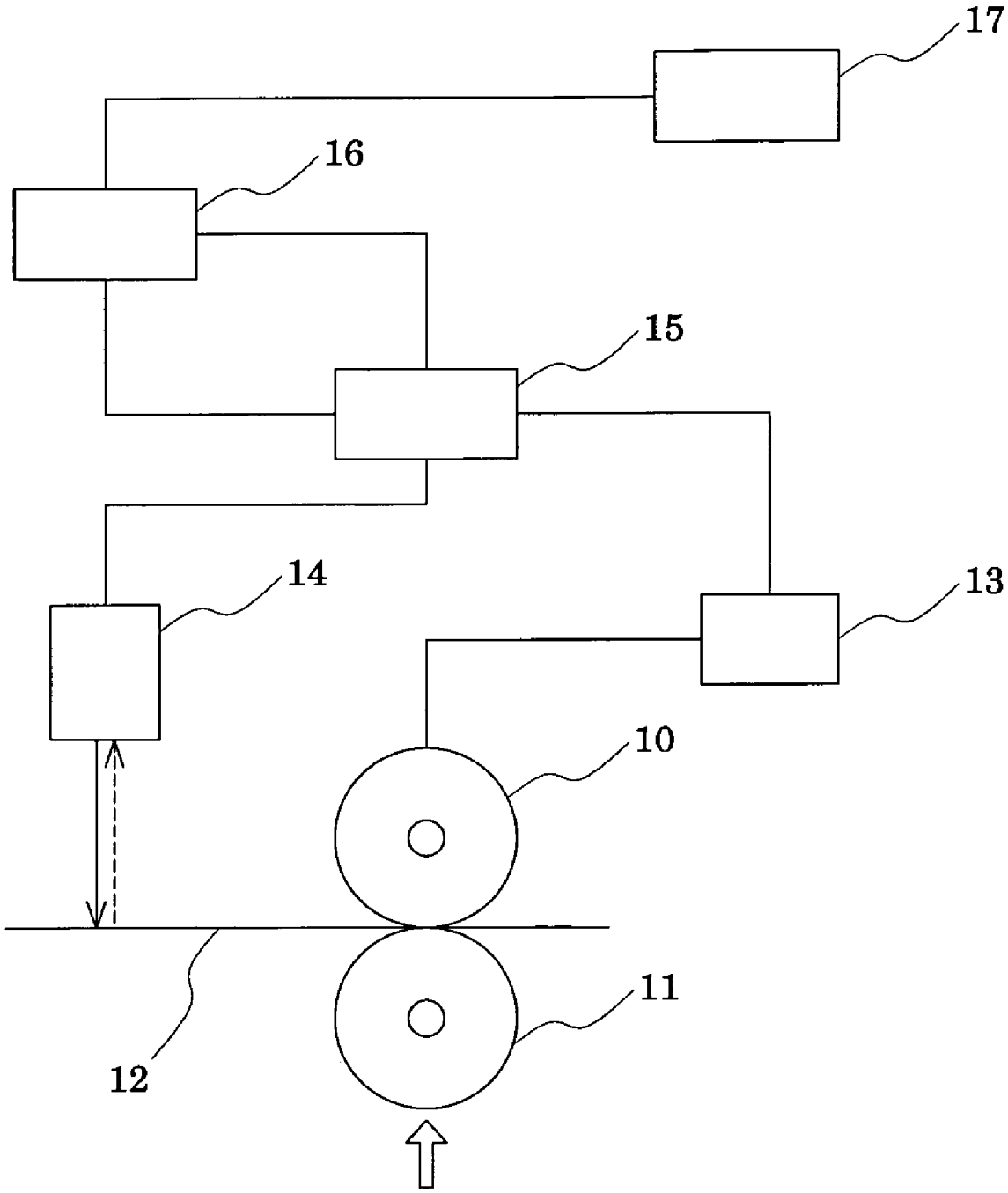
FIG. 3 is a sketch showing a system for determining a sheet transportation distance carried out in Test Example 3.

As shown in FIG. 3, a test paper sheet 12 was inserted between a feed/transport roller 10 and a free roller 11 (outer diameter: 20 mm) opposing the feed/transport roller and conveyed through rotation of the rollers. The feed/transport roller 10 is connected via a clutch (not illustrated) to a motor 13 equipped with an encoder and can be rotationally driven by the motor 13. A laser feed monitor 14 opposing the test paper sheet 12 is also provided. The laser feed monitor 14 is connected to an FFT analyzer 16 and a personal computer 17 via a control box 15, whereby the transportation distance of the test paper sheet 12 corresponding to the rotation of the feed/transport roller 10 can be measured. The control box 15 also regulates the rotation speed tuned by the motor 13. The contact pressure against the feed/transport roller 10 is controlled by appropriately modifying the load imposed on the free roller 11.

Figure 4:
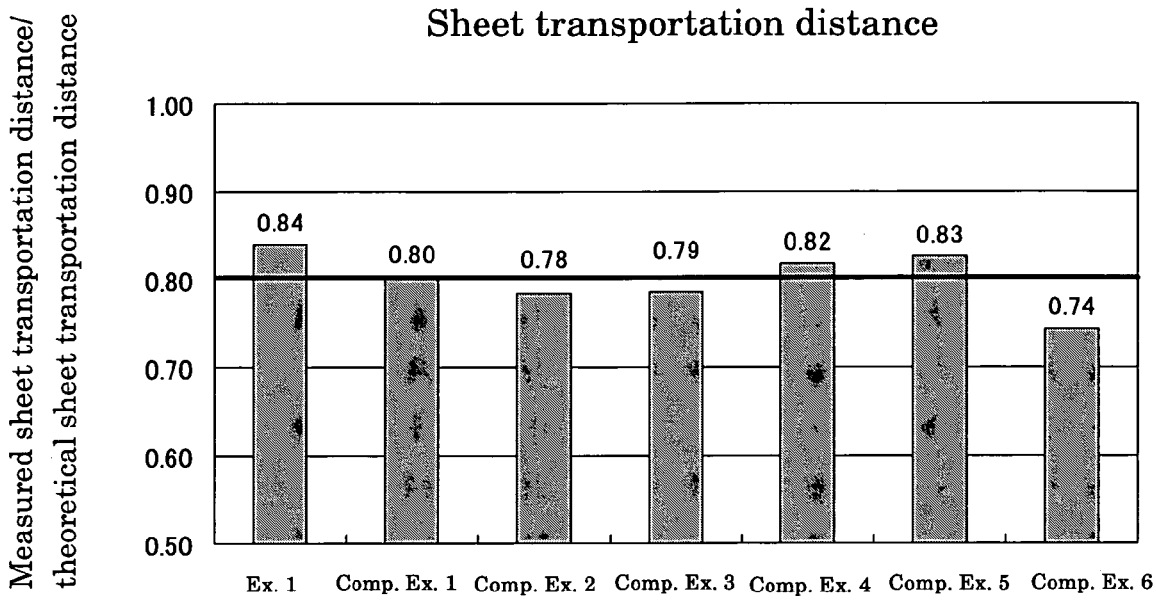
FIG. 4 is a graph showing the results of Test Example 3.

By use of the above test apparatus, a test paper sheet 12 (plain paper: 64 g/m$^2$) was fed by means of the two rollers while the feed/transportation roller 10 was pressed against the free roller 11 at a press load of 100 gf. The sheet transportation distance of the test paper sheet 12 corresponding to the rotation (at 100 rpm) of the feed/transport roller 10 was determined so as to serve as the measured value Dm (mm) of sheet transportation. The theoretical value Dt (mm) of was calculated through multiplication: the outer diameter of the roller (24 mm)×π(3.14). The ratio Fr (Dm/Dt) was calculated. The results are shown in Table 1 and FIG. 4.

Test Example 4

Figure 5:
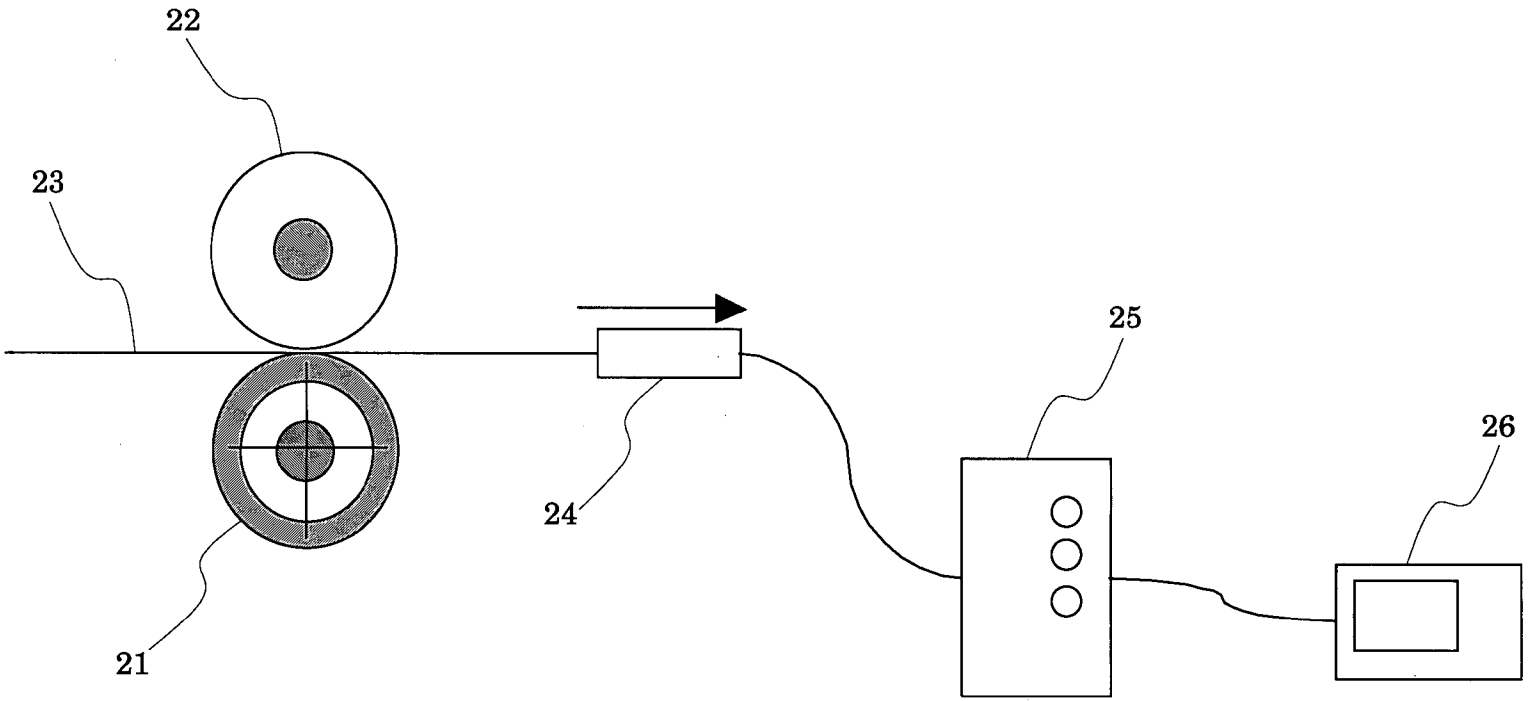
FIG. 5 is a sketch showing a test apparatus employed in Test Example 4.

Each of the feed/transport rollers of Example 1 and Comparative Examples 1 to 6 was subjected to friction coefficient measurement by means of an apparatus shown in FIG. 5, and an output waveform was obtained. Specifically, as shown in FIG. 5, a free roller 22 which was rotatably sustained was pressed against an affixed sample roller 21 at a predetermined load of 200 gf. A test sheet 23 inserted therebetween was conveyed via a load cell 24 at 20 mm/sec. The output from the load cell 24 was detected by means of a detector 26 connected thereto via an amplifier 25. The ratio maximum value (Max) to minimum value (Min), observed in the waveform; i.e., Max/Min=ΔF, was calculated. The measurement was carried out at 23° C. and an RH of 55%. The results are shown in Table 1.

TABLE 1

| | | Change in outer diameter | | | Sheet transportation distance | | | Bleeding | |
|---|---|---|---|---|---|---|---|---|---|
| | Hardness JIS A | Before test mm | After test mm | Percent change % | Theoretical mm | Measured mm | Ratio | Visual observation | ΔF |
| Ex. 1 | 42 | 24.369 | 24.286 | 0.34 | 76.52 | 64.22 | 0.84 | No | 1.08 |
| Comp. Ex. 1 | 42 | 24.312 | 24.020 | 1.20 | 76.34 | 61.35 | 0.80 | No | 1.22 |
| Comp. Ex. 2 | 52 | 24.299 | 24.187 | 0.46 | 76.30 | 59.87 | 0.78 | No | 1.26 |
| Comp. Ex. 3 | 54 | 24.353 | 24.281 | 0.30 | 76.47 | 60.14 | 0.79 | No | 1.31 |
| Comp. Ex. 4 | 35 | 24.226 | 23.407 | 3.38 | 76.07 | 62.18 | 0.82 | No | 1.54 |
| Comp. Ex. 5 | 43 | 24.012 | 23.688 | 1.35 | 75.40 | 62.35 | 0.83 | No | 1.13 |
| Comp. Ex. 6 | 44 | 24.287 | 24.181 | 0.44 | 76.26 | 56.73 | 0.74 | Yes | 1.06 |

As is clear from Table 1 and the Figures, the feed/transport roller of the present invention has low hardness and excellent wear resistance and causes no bleeding. The percent change in outer diameter of the roller of the present invention was found to be as small as 0.34%, which is remarkably small as compared with Comparative Examples 4 and 5 employing EPDM and millable urethane, respectively. The ratio of measured sheet transportation distance to theoretical transportation distance was found to be as remarkably large as 0.84.

In contrast, the roller of Comparative Example 1 employing PTMG serving as a long-chain polyol exhibited a high wear property, thereby providing large percent change in outer diameter. The rollers of Comparative Example 2 employing no plasticizer and Comparative Example 3 employing a low-molecular-weight triol had high hardness values of 52° and 54°, respectively, and exhibited small sheet transportation distance measured values. The roller of Comparative Example 6 employing DOP as a plasticizer caused bleeding, and the measured sheet transportation distance was small.

The feed/transportation roller of the present invention exhibited ΔF of 1.08, which is smaller than 1.22 of the roller of Comparative Example 1 having almost the same hardness. In addition, feeding and transportation of the sheet were confined to generate no abnormal sound or noise.

What is claimed is:

1. A feed/transport roller having an elastic layer comprising a castable polyurethane, which is a reaction product of a polyester-polyol having a number average molecular weight of 1,000 to 3,000 with a polyisocyanate, wherein the elastic layer is formed from the polyester-polyol, the polyisocyanate, an adipic acid ester derivative serving as a plasticizer, a short-chain diol having a molecular weight of 70 to 120 serving as a chain-extender, and a triol as a cross-liking agent, wherein the adipic acid ester derivative has an ether moiety in the molecule and is employed in an amount of 5 to 40 parts by weight with respect to 100 parts by weight of the polyester-polyol, and wherein the triol has an ether moiety in the molecule and has a number average molecular weight of 3,000 to 5,000 serving as a cross-linking agent.

2. A feed/transport roller according to claim 1; wherein the polyester-polyol is a diol produced through condensation of at least one species of nonanediol and methyloctanediol with a dibasic acid.

3. A feed/transport roller according to claim 1, wherein the elastic layer has a rubber hardness Hs (JIS A type) of 20 to 50°.

4. A feed/transport roller according to any one of claims 1 to 3, wherein the roller exhibits a ratio of maximum value (Max) of an output waveform to minimum value (Min) of the output waveform (Max/Min) falling within a range of 1.00 to 1.20, the output waveform being obtained during measurement of friction coefficient.

* * * * *